US006392610B1

(12) United States Patent
Braun et al.

(10) Patent No.: US 6,392,610 B1
(45) Date of Patent: May 21, 2002

(54) ANTENNA DEVICE FOR TRANSMITTING AND/OR RECEIVING RF WAVES

(75) Inventors: Christian Braun, Stockholm; Olov Edvardsson, Täby; Leif Eriksson, Norrtälje; Liu Donghui, Täby, all of (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/712,131

(22) Filed: Nov. 15, 2000

Related U.S. Application Data

(63) Continuation of application No. PCT/SE00/02058, filed on Oct. 24, 2000.

(30) Foreign Application Priority Data

Oct. 29, 1999 (SE) ..... 9903942
Jul. 7, 2000 (SE) ..... 0002617

(51) Int. Cl.[7] ..... H01Q 3/24; H01Q 1/36
(52) U.S. Cl. ..... 343/876; 343/700 MS; 343/702
(58) Field of Search ..... 343/700 MS, 702, 343/742, 867, 770, 767, 876, 853, 795

(56) References Cited

U.S. PATENT DOCUMENTS 4,123,759 A * 10/1978 Hines et al. ..... 343/854
5,243,358 A * 9/1993 Sanford et al. ..... 343/836
5,463,406 A 10/1995 Vannatta et al. ..... 343/725
5,541,614 A 7/1996 Lam et al. ..... 343/792.5
5,777,581 A * 7/1998 Lilly et al. ..... 343/700 MS
5,933,122 A 8/1999 Sauer et al. ..... 343/876
6,034,638 A * 3/2000 Thiel et al. ..... 343/702

FOREIGN PATENT DOCUMENTS

| | | |
|---|---|---|
| EP | 0546803 | 8/1992 |
| EP | 0840394 | 6/1998 |
| JP | 10209932 | 7/1998 |
| WO | WO 99/44307 | 9/1999 |

* cited by examiner

*Primary Examiner*—Tan Ho
(74) *Attorney, Agent, or Firm*—Volentine Francos, PLLC

(57) ABSTRACT

An antenna device for transmitting and/or receiving RF waves connectable to a radio communication device and including a radiating structure with at least two switchable antenna elements. At least one switching element, arranged in a central switching unit, selectively connects and disconnects the at least two switchable antenna elements. The at least two antenna elements can be individually switched between different coupling states by the central switching unit. The central switching unit has a control port for reception of control signals enabling the central switching unit to effect a centralized switching of said at least two switchable antenna elements.

59 Claims, 8 Drawing Sheets

N states,
State i, i=1, set threshold

ANTENNA DEVICE FOR TRANSMITTING AND/OR RECEIVING RF WAVES

CROSS REFERENCE TO RELATED APPLICATIONS

The present invention claims priority to commonly assigned Swedish Patent Application Serial No. 9903942-2 filed Oct. 29, 1999, to Swedish Patent Application Serial No. 0002617-9 filed Jul. 11, 2000, and a continuation application of PCT Patent Application Ser. No. PCT/SE00/02058 filed on Oct. 24, 2000, the entire contents of all of which are hereby incorporated by reference in their entirety for all purposes. The present application is also tN B related to commonly assigned, co-pending U.S. patent applications entitled "Antenna device and method for transmitting and receiving radio waves", "Antenna device and method for transmitting and receiving radio waves", and "Antenna device for transmitting and/or receiving radio frequency waves and method related thereto", all of which were filed the concurrently herewith. These applications are based on the following corresponding PCT applications: PCT/SE00/02057; PCT/SE00/02056; and PCT/SE00/02059, respectively, all filed on Oct. 24, 2000, the entire contents of which are hereby incorporated by reference in their entirety for all purposes.

TECHNICAL FIELD OF THE INVENTION

The present invention relates generally to an antenna device, a radio communication device including the antenna device, and a method for transmitting and receiving electromagnetic waves. More particularly, the present invention is related to an antenna device that is adaptable to a variety of conditions.

BACKGROUND OF THE INVENTION

In modern communication systems, there is an ever increasing demand for making the user devices smaller. This is especially important when it comes to hand portable terminals (terminals), for example mobile phones. The design of the hand portable terminals must permit the terminals to be easily and rapidly manufactured at low costs. Still the terminals must be reliable in use and exhibit a good performance.

It is well known that the size of an antenna is a factor that must be considered in the design of the antenna as it may impact the antenna's performance. Moreover, the interaction between antenna, phone body and the nearby environment (such as the user) must also be considered when designing the antenna. Additionally, there is often a requirement that two or more frequency bands shall be supported, further adding to the number and complexity of factors to be considered by the antenna designer. To this end, radiating properties of an antenna device for a small-sized structure (such as a hand portable terminal) heavily depend on the shape and size of the support structure of the phone (such as a printed circuit board, PCB) as well as on the phone casing. All radiation properties, such as resonance frequency, input impedance, radiation pattern, impedance, polarization, gain, bandwidth, and near-field pattern are products of the antenna device itself and its interaction with the support structure of the phone and the phone casing. Additionally, objects in the nearby environment affect the radiation properties.

The above considerations require the antenna device to be more compact, versatile while exhibiting good antenna performance. As can be appreciated, the performance of the antenna depends on the design of the terminal in which it is to be used as well as on objects in the nearby environment of the antenna device.

With the above factors in mind, it can be appreciated that the design of a antenna devices in terminals, the antenna is tailored to the characteristics of this specific terminal and to be suited for a "normal" use in a "normal" environment. This means that the antenna device cannot later on be adapted to any specific condition under which a certain terminal is to be used or to suit a different terminal. Thus, each model of a terminal, such as a hand portable phone, must be provided with a specifically designed antenna, which normally cannot be optimally used in any other terminal model or cannot be optimally adapted to a variety of nearby environments.

Accordingly, conventional antenna devices lack the versatility and adaptability that is desirable in modern communication terminals. What is needed, therefore, is an antenna that is more versatile and adaptable, and which affords good performance characteristics in a variety of devices and environments.

What has been stated above is true also with respect to radio communication systems used in other apparatuses than portable phones, such as cordless telephones, telemetry systems, wireless data terminals, etc. Thus, even if the antenna device of the invention is described in connection with portable phones it is applicable on a broad scale in various radio communication apparatuses.

Current solutions include distributed control of antenna segmenst, diversity antennas, and phased array radar systems. However, none of these arrangements provide versatile antenna devices that can be adapted to a wide variety of conditions, especially to conditions in the close-by environment of the device, by controlling a central switching unit.

SUMMARY OF THE INVENTION

The present invention is therefore directed to an antenna device, a communication device including the antenna device and a method of receiving and transmitting electromagnetic waves that substantially overcomes one or more of the problems due to the limitations and disadvantages noted above.

It is an object of the present invention is to provide a versatile antenna device for a communication device, which antenna device is adaptable to various conditions and for obtaining desired functions.

It is also an object of the invention to provide an antenna device, which can be adapted in order to suit different communication apparatuses, such as different models of hand portable phones, after it has been mounted in the apparatus.

Another object of the invention is to provide an antenna device, of which certain characteristics are easily controllable, such as radiation pattern, tuning, polarization, resonance frequency, bandwidth, input impedance, gain, diversity function, near-field pattern, connection of antenna elements as receiving/transmitting elements.

An additional object of the invention is to provide an antenna device including switchable antenna elements and which antenna device is easy to manufacture, and exhibits a controllable interaction between the switch and the antenna elements.

A further object of the invention is to provide an antenna device suited to be used as an integrated part of a radio communication device.

A particular object of the invention is to provide an antenna device, preferably for receiving radio waves, including a patch antenna device switchable between at least two different frequency bands.

Accordingly, the invention of the present disclosure relates generally to an antenna device and method for transmission and/or reception of electromagnetic waves. Illustratively, the antenna device includes radiating structure including at least two antenna elements. The at least two switchable antenna elements are connected to at least one switching element, which is connected to a central switching unit. The at least one switching element is capable of selectively connecting and disconnecting the at least two antenna elements.

As a result of the ability to selectively connect/disconnect particular antenna elements, the antenna device of the present invention achieves the desired versatility to enable optimal transmission and reception of electromagnetic signals in a variety of terminals and in a variety of nearby environments.

The invention is described in greater detail below with reference to the embodiments illustrated in the appended drawings. However, it should be understood that the detailed description of specific examples, while indicating illustrative embodiments of the invention, are given by way of example only, since various changes and modifications within the scope of the claims will become apparent to those skilled in the art reading this detailed description.

BRIEF DESCRIPTION OF THE DRAWINGS

The invention is best understood from the following detailed description when read with the accompanying drawing figures; It is emphasized that the various illustrated features are not necessarily drawn to scale. In fact, the dimensions may be arbitrarily increased or decreased for clarity of discussion.

DETAILED DESCRIPTION OF PREFERRED EMBODIMENTS

Figure 1:
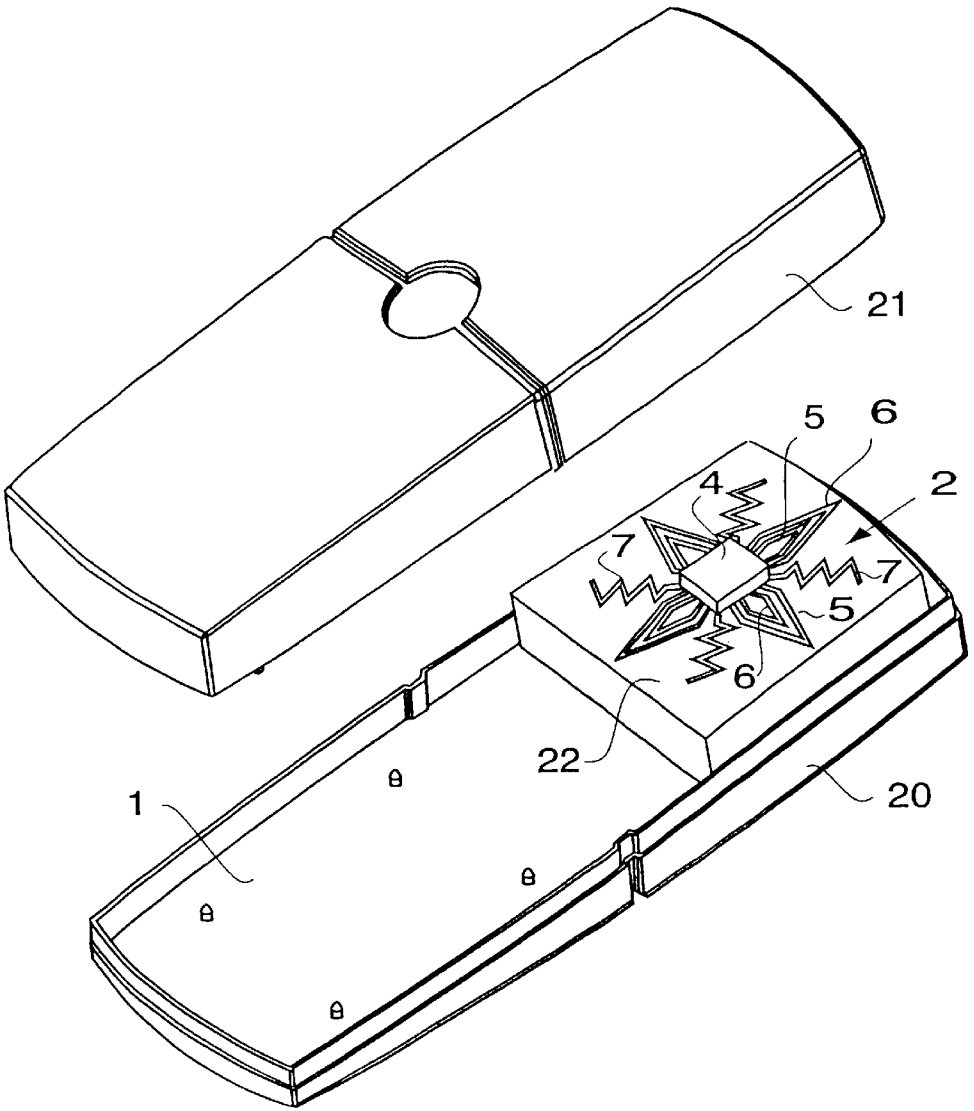
FIG. 1 is a perspective view of two casing parts of a portable telephone including an exemplary embodiment of an antenna device according to the present invention.

Referring initially to FIG. 1, an illustrative embodiment of the present invention is shown. An antenna device 2 includes a radiating structure 8 including at least two antenna elements 5, 6, 7. The at least two switchable antenna elements 5, 6, 7, are connected to at least one a switching element (not shown in FIG. 1), which is connected to a central switching unit 4. The at least two switchable antenna elements may then be selectively switched on or off by the central switching unit 4. In FIG. 1, reference numerals 20, 21 are the front part and the back part, respectively, of the casing of an illustrative portable telephone. The main printed circuit board, PCB, of the phone may be mounted in the space 1 in the front part of the casing. An antenna device 2 of the present invention is printed on a separate supporting device 22 in this embodiment. The support can be a flexible substrate, an MID (Molded Interconnection Device) or a PCB. However, the antenna could have been printed on the main PCB, as well, which can extend along the length of the front part of the casing. Between the phone circuit on the PCB and the antenna device there are RF feed lines and control lines (not shown) for the central switching unit 4.

In the exemplary embodiment of FIG. 1, the antenna device 2 includes a central switching unit 4. The central switching unit 4 includes a matrix of electrically controllable a switching elements (not shown). The at least one switching element may be based on microelectro-mechanical system switches (MEMS), PIN diode switches, or Gallium Arsenide based field effect transistors (GaAs FET) switches. Of course, these are merely examples of switching elements that can be used in carrying out the present invention. One having ordinary skill in the art will recognize that switching elements based on technologies different than those mentioned above could be used.

By selected switching of the at least two switchable antenna elements 5, 6, 7 by the switching elements controlled by the central switching unit 4, the radiation pattern of the antenna can be shaped according to demand by appropriate selection of antenna elements. In this way losses due to objects in the close-by environment of the antenna device, such as the user of a portable phone, can be minimized among other things. As described more fully herein, the present invention allows the control of the tuning; polarization; bandwidth; resonance frequency; radiation pattern; gain; input impedance; near-field pattern of the antenna device, to include a diversity function; and the ability to change an antenna element from being an element connected to the transmitter circuitry to be an element connected to the receiver circuits of a radio communication device.

Clearly, the above-mentioned parameters of a small-sized radio communication device may be adversely affected by objects in the proximity of the device. Proximity or close-by environment herein refers to the distance within which the effect on the antenna parameters is noticeable. This distance extends roughly about one wavelength (at the particular transmission/reception wavelength)from the device. By altering the antenna configuration by use of switching elements controlled by the switching unit 4 this influence on the antenna parameters by an external object can be reduced. Herein lies an advantage of the present invention compared to conventional antenna devices mentioned above. The antenna device 2 of the illustrative embodiment of the present invention may be adapted to any specific condition under which a certain terminal is to be used or to suit a different terminal. Thus, each model of a terminal, such as a hand portable phone, does not require a specifically designed antenna, which normally cannot be optimally used in any other terminal model or cannot be optimally adapted to a variety of nearby environments. Finally, the present invention may be incorporated into wireless and other hand-held devices or terminals. These terminals transmit/receive electromagnetic waves illustratively in the following spectra: radio frequency (rf),microwave, and millimeter wave. This list is meant to be representative and not exhaustive and other wavelength electromagnetic waves may be transmitted/received by use of the present invention.

The switching unit 4 is surrounded by a pattern of antenna elements. Each antenna element is connected to a respective switch in the switching unit arranged for connecting and disconnecting the antenna element. In this embodiment the radiating structure includes four loop-shaped antenna elements 5. Within each of the loops 5 a loop-shaped parasitic element 6 is formed. Between each pair of loop-shaped elements 5, 6 a meander-shaped antenna element 7 is arranged. The at least two switchable antenna elements form a symmetrical pattern around the switching unit 4. However, in certain applications the at least two switchable antenna elements can form an unsymmetrical pattern in order to build in different antenna characteristics in different directions. Further, the radiation structure can include additional antenna elements not connected to the switching unit.

The switching unit 4 the loop-shaped enables antenna elements to be connected in parallel or in series with each other, or some elements can be connected in series and some in parallel. Further, one or more elements can be completely disconnected or connected to an RF ground. One or more of the meander-shaped antenna elements 7 can be used separately or in any combination with the loop antenna elements. The meander elements can also be segmented so that only one or more selected portions thereof can be connected if desired.

Although not illustrated in FIG. 1, other types of antenna elements, such as patch antennas, slot antennas, whip antennas, spiral antennas, and helical antennas can also be used as will be described below. In all cases, the switching unit may or may not be surrounded by the at least two switchable antenna elements. The switching unit can also be positioned on one side.

All switching of the at least two switchable antenna elements is centralized to the switching unit 4, which can be very small with a controllable interaction with the antenna function. Further, as all switching is centralized to the unit 4, switch control signals need only be supplied to that unit which simplifies the overall antenna structure among other things. These are important advantages of the present invention over prior art solutions.

The central switching unit 4 controls the connection/-disconnection of the at least two switchable antenna elements. By appropriate selection of the combination of antenna elements which is connected to the RF feed, i.e. the antenna configuration state, the impedance and/or the resonance frequency of the antenna device can be adjusted without the need for separate connection or disconnection of discrete components. The same effect can be achieved by using parasitic elements, not connected to RF feed, but connected to RF ground or unconnected. The parasitic elements can also be connected to the switching unit. In case it would be desired also to use discrete components in any application these can be easily connected or disconnected by means of the same central switching unit as the other antenna elements.

Below, the invention will be described in further detail with reference to FIGS. 2–12, which schematically illustrate examples of patterns of antenna elements which may be employed according to the invention.

Figure 2:
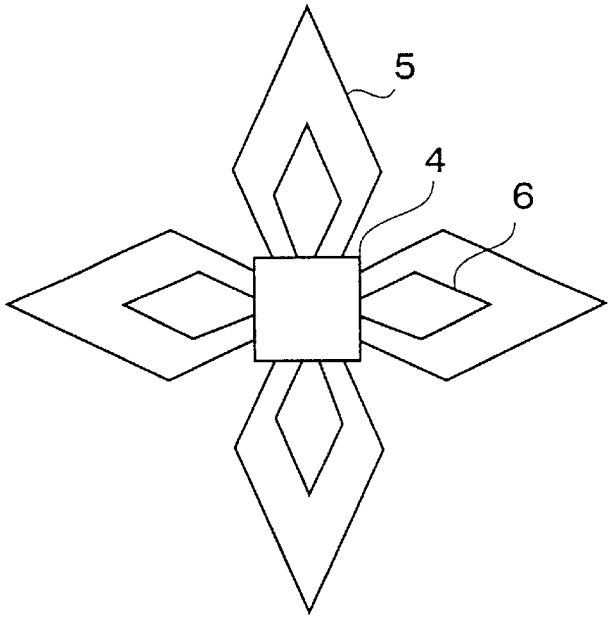
FIGS. 2–14 schematically illustrate additional exemplary embodiments of an antenna device according to the present invention.

FIG. 2 is an example of an antenna device including a plurality of loop antenna elements 5, 6 as in FIG. 1. The loop antenna elements are arranged so that they start and end at the switching unit 4. By means of the switching unit the loop elements can be connected to an RF feed line, short-circuited, coupled in series or in parallel with each other. Each element can therefore be seen as a portion of the total antenna structure, from now on called "the total antenna", which properties are determined by the state of the switching unit 4. That is, the switching unit decides how the loop element portions are connected and electrically arranged. At least some of the elements 5 can act as an actively radiating element, where the excitation is achieved through direct connection to an RF feed. Possibly, some of the elements 6 can act as parasitic elements, where the excitation of the elements is achieved through parasitic coupling to other antenna elements.

The loop antenna elements can be shaped as three-dimensional structures. Parts or all of the structure can be positioned above the PCB. The pattern can go around, or through the PCB, so that part of the pattern is on the other side of the PCB. Some or all parts of the pattern can extend perpendicularly to the PCB.

There can be permanent shorting pins and/or components attached to the at least two switchable antenna elements outside of the switching device. The feeding of the at least two switchable antenna elements can also take place outside of the switching device.

The purpose of changing the switch state can be to tune the total antenna to a desired frequency. This can be done by connecting several loop elements in series so that the electrical length is appropriate for the desired frequency.

Another purpose can be to match the antenna to a desired impedance. This can be done by switching in/out parasitic elements. The mutual coupling between the elements adds to the input impedance of the active element, changing the resulting input impedance in a desired manner.

Yet another purpose can be to change the radiation pattern of the total antenna. This can be done by altering the connection of antenna portions so that the radiating currents are altered. This can also be done by switching in/out parasitic elements, thereby directing or reflecting the radiation towards a desired direction.

Figure 3:
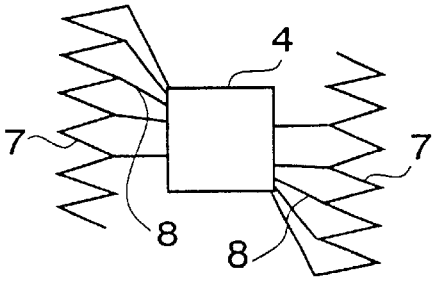

FIG. 3 shows an example of the antenna device, where two meandering antenna elements 7 are connected to the central switching unit 4. The expression "meandering" element is intended also to cover other elements with similar shape and function, such as zigzag shape, snake shape, fractal shape, etc. What has been stated above in connection with the loop antenna elements in FIG. 2 is applicable also regarding the meander-shaped elements of FIG. 3, as is realized by the person skilled in this art, the only difference being the inherent difference in radiation characteristics between these two types of antenna elements, as is well known in the art.

In FIG. 3 the reference numerals 8 indicate connection lines, by means of which the RF feed and/or RF ground points of the meander element can be switched between different positions along the element. The aim of this can be to change the input impedance for matching purposes or to change the current flow for radiation pattern control.

Figure 4:
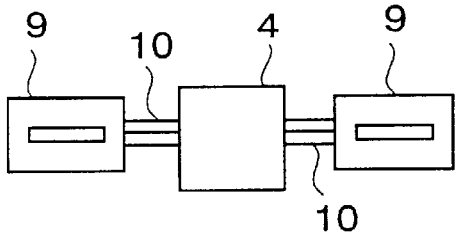

FIG. 4 shows an example of an antenna device, where slot antenna elements 9 are connected to the central switching unit 4. The slot antenna elements are connected to the switching unit via connection lines 10. The lines 10 can be connected directly to an RF feed device, shorted, coupled in series or in parallel with lines to other antenna elements. Each connection line can act as an active feed line and be connected directly to an RF feed device. One can also use a parasitic coupling, where there is no direct connection to any RF feed.

At least one slot element 9 of the antenna device is fed by at least one connection line 10, and in various ways tuned by the other lines. For example, the other lines can be shorted or left open so that the slot antenna element, and in effect the whole antenna device, is tuned for a desired frequency band. The same technique can be used to change the radiation pattern of the wireless terminal, to which the antenna device is coupled, pattern-shaping. Moreover, connecting, disconnecting or tuning other slot elements can provide tuning or pattern-shaping.

Figure 5:
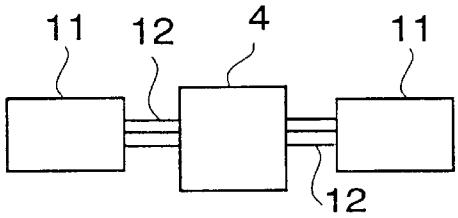

FIG. 5 shows an example of an antenna device similar to that of FIG. 4 but where two patch antenna elements 11 are connected to the central switching unit 4 via connection lines 12. The patch antenna elements are placed closed to or in connection to the central switching unit. What has been stated above in connection with FIG. 4 is relevant also for the embodiment of FIG. 5.

The purpose of changing the switch state can be to tune the total antenna to a desired frequency. This can be done by connecting several patch antenna elements in series so that the electrical length of the resulting antenna is appropriate for the desired frequency.

Another purpose can be to match the antenna to a desired impedance. This can be done by switching in/out RF ground at some connection points not connected to RF feed, or by changing the connection point that is connected to RF feed. This can also be done by switching in/out parasitic elements. The mutual coupling between the elements contributes to the input impedance of the active element, changing the resulting input impedance in a desired manner.

Yet another purpose can be to change the radiation pattern of the total antenna. This can be done by altering the connection of antenna portions so that the radiating currents are altered. This can also be done by switching in/out parasitic elements, thereby directing or reflecting the radiation towards a desired direction.

Figure 6:
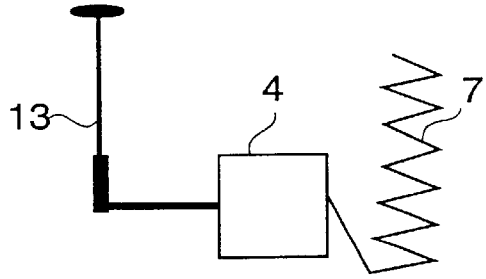
Figure 7:
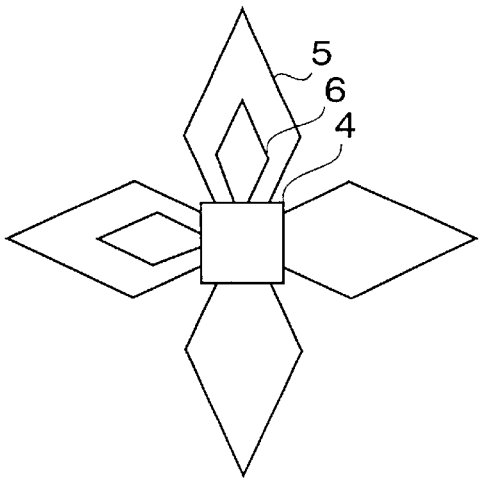
Figure 8:
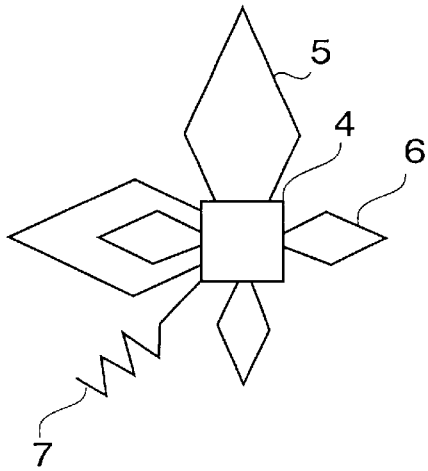
Figure 9:
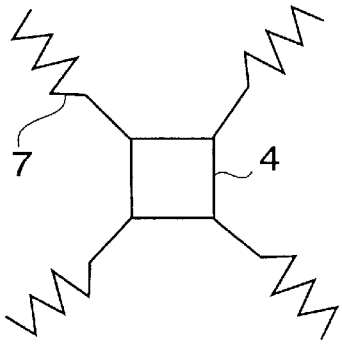
Figure 10:
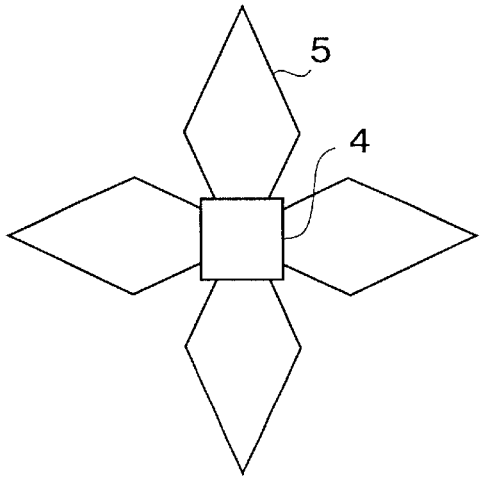
Figure 11:
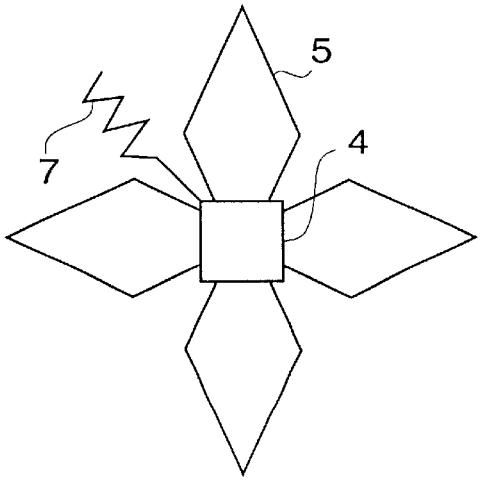
Figure 12:
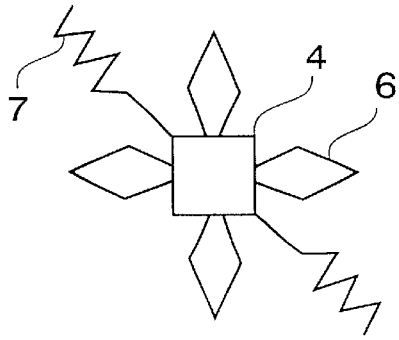

FIG. 6 shows an example of an antenna device, where a meander element 7 is connected to the central switching unit 4 together with a whip antenna element 13.

The whips and meander elements can be connected directly to an RF feed device, shorted or coupled in parallel/series. Each element can act as an active radiating element, that is be connected directly to an RF feed device or as a parasitic element, where there is no galvanic connection to an RF feed device.

For example, the electrical length of the whip 13 and/or the meander 7 can be altered to tune the resonance frequency. There can be other parasitic elements, not shown, close to the whips and/or the meander for tuning and/or for changing the radiation pattern. In this way the radiation pattern can be mainly directed towards a desired direction. The whip element can be replaced by a helical antenna element or combined with such.

Of course, the antenna device can include a central switching unit and any combination of the above described antenna elements forming a symmetrical or an unsymmetrical pattern of radiating elements. Some examples are shown in FIGS. 7–12, in which the reference numerals stand for the same elements as in the previous FIGS. 1–6. Each antenna element can be used separately or in any combination with the other elements. The elements themselves can also be combinations of various antenna types, such as meandered loop patterns and combined patch and meander patterns, etc.

Further, some antenna elements can be used as receiving antennas and some elements as transmitting antennas. The antenna device can be adapted for operation in several frequency bands and for receiving and transmitting radiation of different polarization. In addition the switching unit 4 can be used to connect or disconnect discrete matching components. The invention is not limited to any specific shape of the individual antenna elements as the shapes can be chosen according to the desired function.

A small-sized wireless device, such as a mobile phone, can be used in many different ways. It can for example be held to the ear as a telephone, it can be put in a pocket, it can be attached to a belt at the waist, it can be held in the hand, or it can be put on a metal surface. Many more scenarios can be found, and they can all be referred to as different usage scenarios. Common for all scenarios is that there may be objects in the proximity of the device, thereby affecting the antenna parameters of the device. Usage scenarios with differing objects in the proximity of the device have different influence on the antenna parameters.

Below are listed two specific usage scenarios:

Free Space scenario (FS): The device is held in free space, i.e. with no objects in the proximity of the device. Air surrounding the device is considered free space. Many usage scenarios can be approximated with this scenario. Generally, if the scenario has little influence on the antenna parameters, it can be referred to as free space.

Talk Position scenario (TP): The device is held to the ear by a person, as a telephone. The influence on the antenna parameters varies depending on which person is holding the device and exactly how the device is held. Here, the TP scenario is considered a general case, covering all individual variations mentioned above.

Various radiation-related parameters that may be controlled by means of an antenna device in accordance with the invention will be described in more detail with reference to FIGS. 13 and 14.

Figure 13:
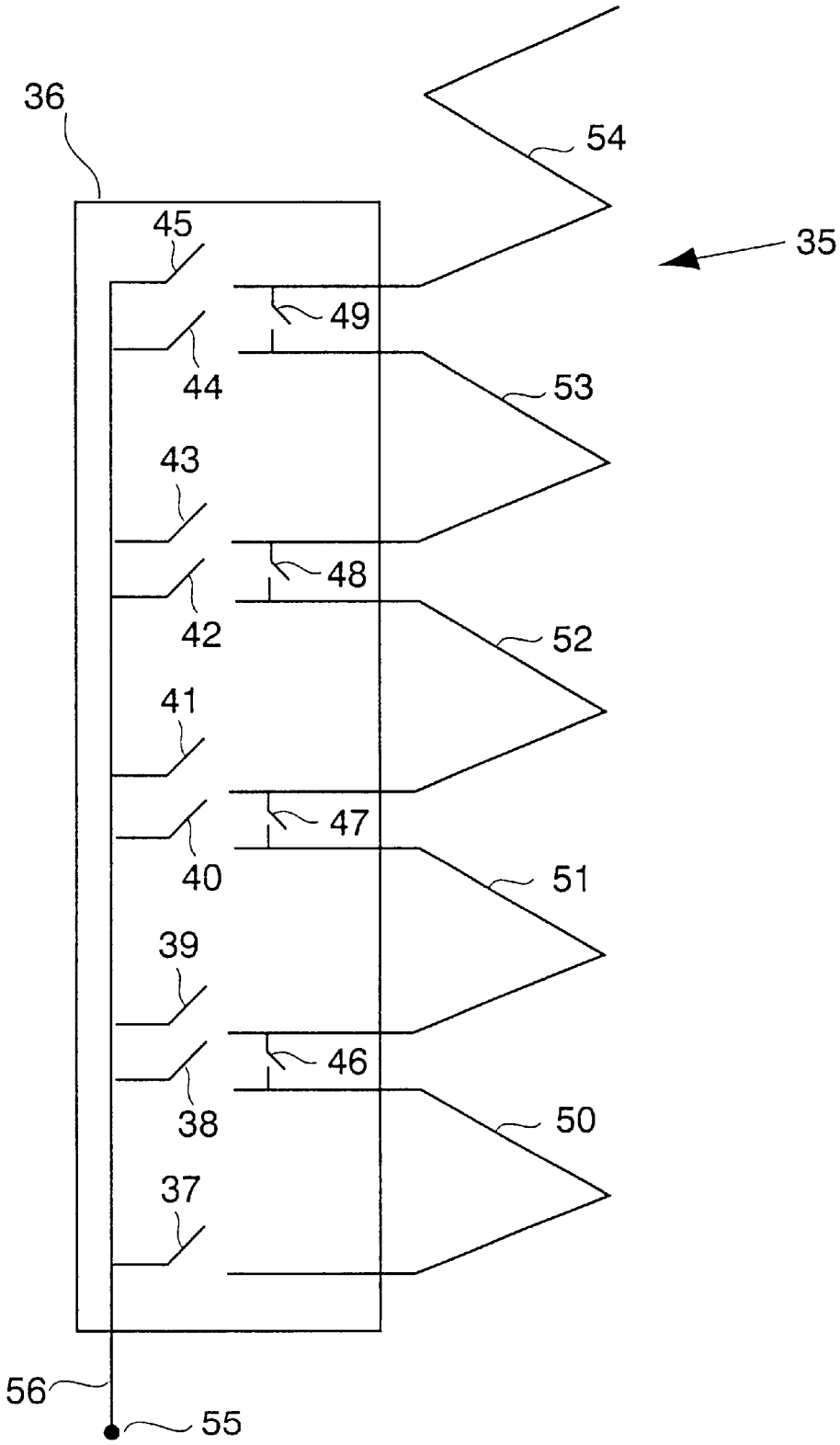

Resonance Frequency (FIG. 13)

Antennas for wireless radio communication devices experience detuning due to the presence of the user. For many antenna types, the resonance frequency drops considerably when the user is present (TP), compared to when the device is positioned in free space (FS). An adaptive tuning between free space, FS, and talk position, TP, can reduce this problem substantially.

A straightforward way to tune an antenna is to alter its electrical length, and thereby altering the resonance frequency. The longer the electrical length is, the lower is the resonance frequency. This is also the most straightforward way to create band switching, if the change in electrical length is large enough.

In FIG. 13 is shown a meander-like antenna structure 35 arranged together with a central switching unit 36 including a plurality of switches 37–49. Antenna structure 35 may be seen as a plurality of aligned and individually connectable antenna elements 50–54, which are connectable to a feed point 55 through the switching unit 36 and a feed line 56. Feed point 55 is further connected to a low noise amplifier of a receiver circuitry (not shown) of a radio communication device, and hence antenna structure 35 operates as a receiving antenna. Alternatively, feed point 55 is connected to a power amplifier of a radio communication transmitter for receiving an RF power signal, and hence antenna structure 35 operates as a transmitting antenna.

A typical example of operation is as follows. Assume that switches 37 and 46–49 are closed and remaining switches are opened and that such an antenna configuration state is adapted for optimal performance when the antenna device is arranged in a hand-portable telephone located in free space.

When the telephone is moved to talk position, the resonance frequency will be lowered by influence of the user and thus, in order to compensate for the presence of the user, switch 49 is opened, whereby the electrical length of the connected antenna structure is reduced and accordingly the resonance frequency is increased. This increase shall with an appropriate design of antenna structure 35 and switching element 36 compensate for the reduction as introduced when the telephone is moved from free space to talk position.

The same antenna structure 35 and switching element 36 may also be used for switching between two different frequency bands such as GSM900 and GSM1800.

For instance, if an antenna configuration state, which includes antenna elements 50–53 connected to feed point 55 (switches 37 and 46–48 closed and remaining switches opened), is adapted to suit the GSM900 frequency band, switching to the GSM1800 frequency band may be effectuated by simply opening switch 47, whereby the electrical length of the presently connected antenna structure (elements 50 and 51) is reduced to approximately half the previous length, implying that the resonance frequency is approximately doubled, which would be suitable for the GSM1800 frequency band.

According to the invention all switching of the elements 50–54 required for different purposes is centralized to the switching unit 36, which is provided with a single feed line.

Figure 14:
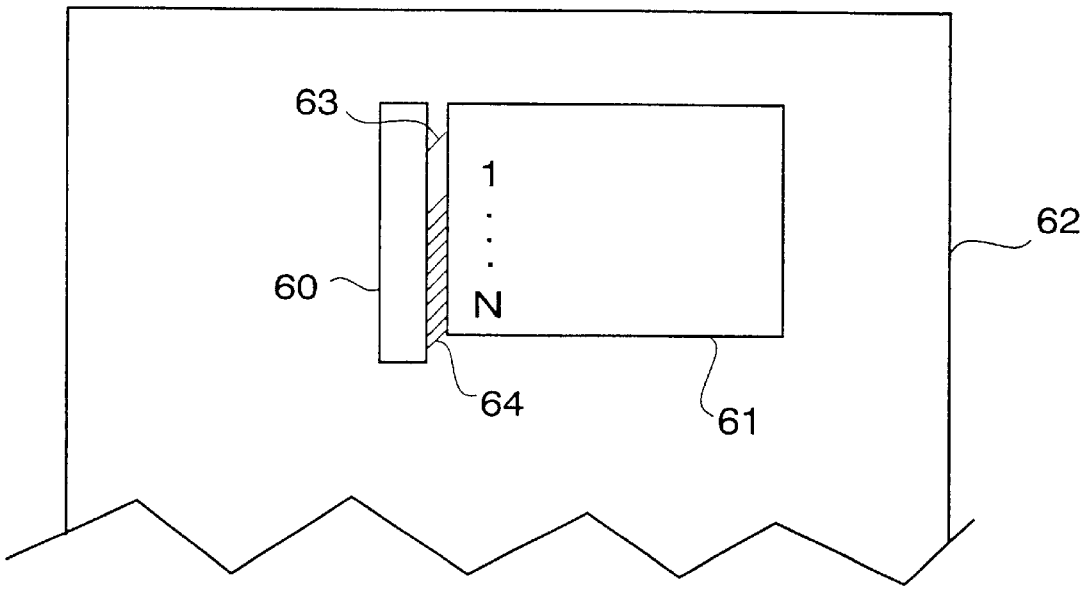

Impedance (FIG. 14)

Instead of tuning a detuned antenna, one can perform adaptive impedance matching, which involves letting the resonance frequency be slightly shifted and compensate this detuning by means of matching.

An antenna structure can have feed points at different locations. Each location has a different ratio between the E and H fields, resulting in different input impedances. This phenomenon can be exploited by switching the feed point, provided that the feed point switching has little influence on the resonance frequency of the antenna. When the antenna experiences detuning due to the presence of the user (or other object), the antenna can be matched to the feed line impedance by altering for example the feed point of the antenna structure. In a similar manner, RF ground points can be altered.

In FIG. 14 is schematically shown an example of such an implementation of an antenna structure 61 that can be selectively grounded at a number of different points spaced apart from each other. Antenna structure 61 is in the illustrated case a planar inverted F antenna (PIFA) mounted on a printed circuit board 62 of a radio communication device. Antenna 61 has a feed line 63 and N different spaced RF ground connections 64. By switching from one RF ground connection to another, the impedance is slightly altered.

As before all switching functions are centralized to a central switching unit 60.

Moreover, switching in/out parasitic antenna elements can produce an impedance matching, since the mutual coupling from the parasitic antenna element to the active antenna element produces a mutual impedance, which contributes to the input impedance of the active antenna element.

Other typical usage positions than FS and TP can be defined, such as for instance waist position, pocket position, and on an electrically conductive surface.

Each case may have a typical tuning/matching, so that only a limited number of points needs to be switched through. If outer limits for the detuning of the at least two switchable antenna elements can be found, the range of adaptive tuning/matching that needs to be covered by the antenna device can be estimated.

One implementation is to define a number of antenna configuration states that cover the tuning/impedance matching range. There can be equal or unequal impedance.difference between each antenna configuration state.

Radiation Pattern

The radiation pattern of a wireless terminal is affected by the presence of a user or other object in its near-field area. Loss-introducing material will not only alter the radiation pattern, but also introduce loss in radiated power due to absorption.

This problem can be reduced if the radiation pattern of the terminal is adaptively controlled. The radiation pattern (near-field) can be directed mainly away from the loss-introducing object, which will reduce the overall losses.

A change in radiation pattern requires the currents producing the electromagnetic radiation to be altered. Generally, for a small device (e.g. a hand-portable telephone), there need to be quite large changes in the antenna structure to produce altered currents, especially for the lower frequency bands. However, this can be done by switching to another antenna type producing different radiation pattern, or to another antenna structure at another position/side of the PCB of the radio communication device.

Another way may be to switch from an antenna structure that interacts heavily with the PCB of the radio communication device (e.g. whip or patch antenna) to another antenna not doing so (e.g. loop antenna). This will change the radiating currents dramatically since interaction with the PCB introduces large currents on the PCB (the PCB is used as main radiating structure).

Figure 15:
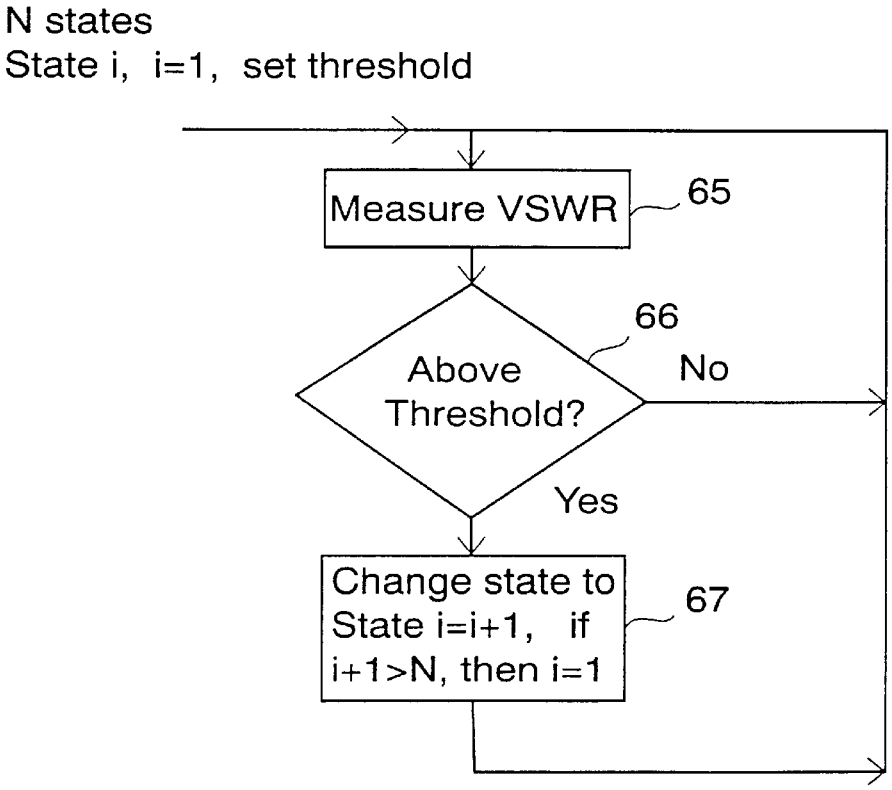
FIG. 15 is a flow diagram of an example of a switch-and-stay algorithm for controlling a central switching unit of an inventive antenna device according to an illustrative embodiment of the present disclosure.
Figure 16:
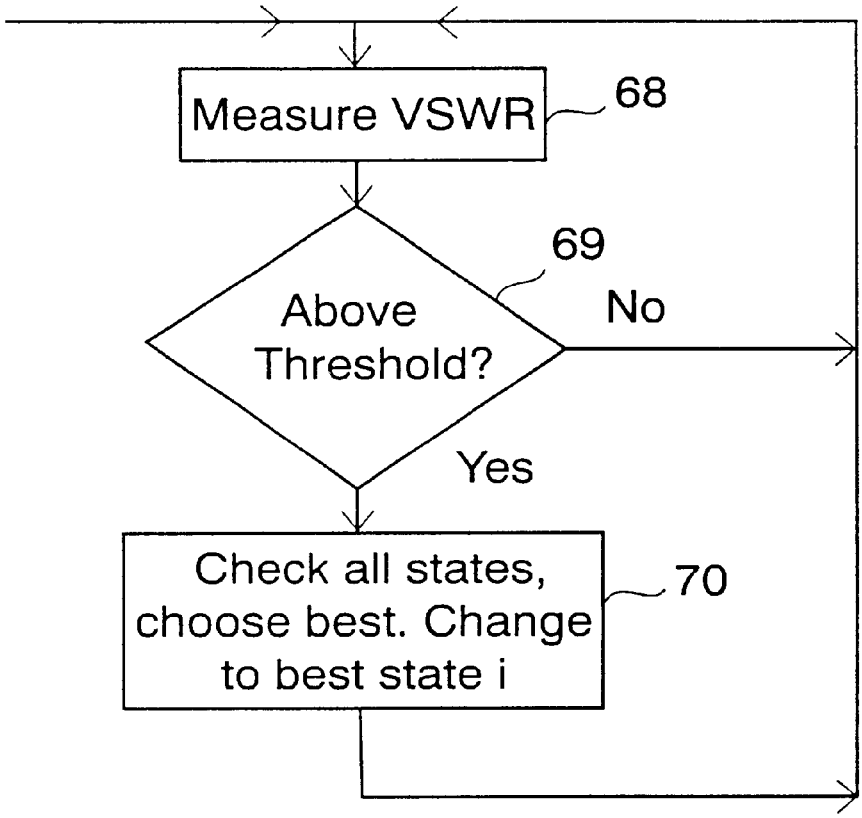
FIG. 16 is a flow diagram of an alternative example of an algorithm for controlling a central switching unit of an antenna device according to an exemplary embodiment of the present disclosure.
Figure 17:
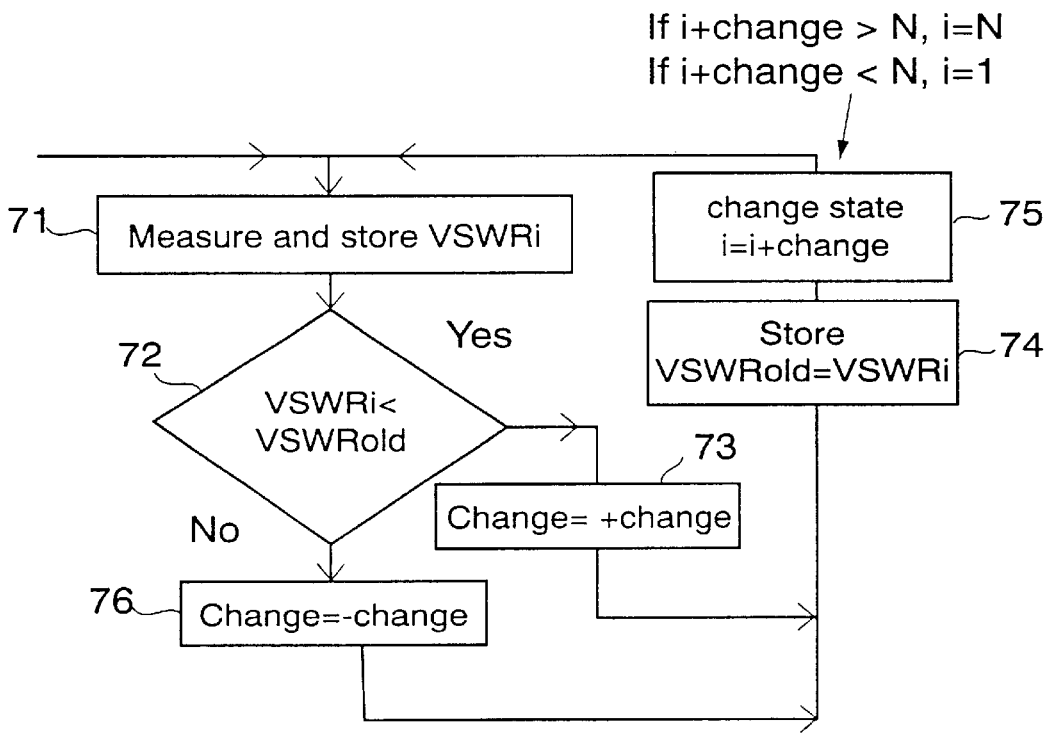
FIG. 17 is a flow diagram of a further alternative example of an algorithm for controlling a central switching unit of an antenna device according to an exemplary embodiment of the present disclosure.

Algorithms (FIGS. 15–17)

An object in the near-field area of a device will alter the antenna input impedance. Therefore, a measure of the reflection coefficient on the transmitter side, e.g. the Voltage Standing Wave Ratio, VSWR, may be a good indicator of when there are small losses. Small changes in VSWR as compared to VSWR of free space imply small losses due to nearby objects. However, other optimization parameters than WSWR can be used, such as measures of received signal quality, e.g. Bit Error Rate, BER, Carrier to Noise Ratio, C/N, Carrier to Interference Ratio, C/I, received signal strength, or a combination of two or more measurable quantities. Also the received signal strength and measures of the diversity performance, e.g. the correlation between the signals, can be used. If the transmitter and receiver antennas are separated an algorithm can take information from the transmitter antenna (e.g. VSWR) to tune the receiver antenna, and the other way around. The optimization parameters are treated in some kind of algorithm in order to determine the states of the switches in the central switching unit.

The discussion above concerns the antenna near field and losses from objects in the near field. However, by means of an antenna in accordance with the present invention it will be possible to direct a main beam in the far-field area in a favorable direction producing good signal conditions. Similarly, the polarization can be changed in a desired manner.

The invention will be exemplified below by means of some algorithms, which use the reflection coefficient as an optimization parameter. In the following examples we use VSWR as a measure of the reflection coefficient. However, the algorithms can be implemented with any other measure of operation parameters.

All described algorithms will be of trial-and-error type, since there is no knowledge about the new state until it has been reached.

Below, with reference to FIGS. 15–17, some exemplary algorithms for controlling the antenna are depicted.

The simplest algorithm is probably a switch-and-stay algorithm as shown in the flow diagram of FIG. 15. Here switching is performed between predefined states i=1, . . . , N (e.g. N=2, one state being optimized for FS and the other state being optimized for TP) . A state i=1 is initially chosen, whereafter, in a step 65, the VSWR is measured. The measured VSWR is then, in a step 66, compared with a predefined limit (the threshold value). If this threshold is not exceeded the algorithm is returned to step 65 and if it is exceeded there is a switching performed to a new state i=i+1. If i+1 exceeds N, switching is performed to state 1. After this step the algorithm is returned to step 65.

Using such an algorithm, each state 1, . . . , N is used until the detected VSWR exceeds the predefined limit. When this occurs the algorithm steps through the predefined states until a state is reached, which has a VSWR below threshold. Both the transmitter and receiver antenna structures can be switched at the same time. An arbitrary number of states may be defined, enabling switching to be performed between a manifold of states.

Another example is a more advanced switch-and-stay algorithm as shown in the flow diagram of FIG. 16. In the same way as the previous algorithm, N states are predefined, and a state i=1 is initially chosen, whereafter, in a step, 68, the VSWR is measured, and, in a step 69, compared with the threshold value. If the threshold is not exceeded the algorithm is returns to step 68. If the threshold is exceeded, the algorithm proceeds to step 69, wherein all states are switched through and VSWR is measured for each state. All VSWR's are compared and the state with the lowest VSWR is chosen.

Step 70 may look like:

for i=1 to N
  switch to State i
  measure VSWR (i)
  store VSWR (i)
switch to State of lowest VSWR Finally, the algorithm is returned to step 68. Note that this algorithm may require quite fast switching and measuring of the VSWR, since all states have to be switched through.

A further alternative algorithm particularly suited for an antenna structure having a manifold of predefined antenna configuration states, which may be arranged so that two adjacent states have radiating properties that deviate only slightly is shown in FIG. 17. N states are predefined, and initially a state i=1 is chosen and a parameter VSWRold is set to zero, and a variable "change" is set to +1. In a first step 71 VSWRi (VSWR of state i) is measured and stored, whereafter in a step 72 the VSWRi is compared with VSWRold. If, on one hand, VSWRi<VSWRold a step 73 follows, wherein "change" is set to +"change" (this step is not really necessary). Steps 74 and 75 follow, wherein VSWRold is set to present VSWR, i.e. VSWRi, and the antenna configuration state is changed to i+"change", i.e. i=i+"change", respectively. The algorithm is then returned to step 71. If, on the other hand, VSWRi >VSWRold, a step 76 follows, wherein variable "change" is set to –"change". Next, the algorithm continues to step 74 and 75. Note that in this case the algorithm changes "direction".

It is important to use a time delay to run the loops (71, 72, 73, 74, 75, 71 and 71, 72, 76, 74, 75, 71, respectively) only at specific time steps, as the switched state is changed at every loop turn. At 72 a present state (VSWRi) is compared with the previous one (VSWRold). If the VSWR is better than the previous state, a further change of state in the same "direction" is performed. When an optimum is reached the antenna configuration state as used will typically oscillate between two adjacent states at every time step. When end states 1 and N, respectively, are reached, the algorithm does not continue further to switch to states N and 1, respectively, but stays preferably at the end states until it switches to states 2 and N–1, respectively.

The algorithm assumes relatively small differences between two adjacent states, and that the antenna configuration states are arranged so that the changes are decreasing in one direction and increasing in the opposite direction. This means that between each state there is a similar quantity of change in, for example, resonance frequency. For example, small changes in the separation between RF feed and RF ground connections at a PIFA antenna structure would suit this algorithm perfectly, see FIG. 14.

In all algorithms there may be a time delay to prevent switching on a too fast time scale. It may also be necessary to perform the switching in specific time intervals adapted to the operation of the radio communication device.

As a further alternative (not shown in the Figures), a controller of the antenna-device may hold a look-up table with absolute or relative voltage standing wave ratio (VSWR) ranges, of which each is associated with a respective state of the central switching unit. Such a provision would enable the controller to refer to the look-up table for finding an appropriate state given a measured VSWR value, and for adjusting the switching unit to the appropriate antenna configuration state.

Figure 18:
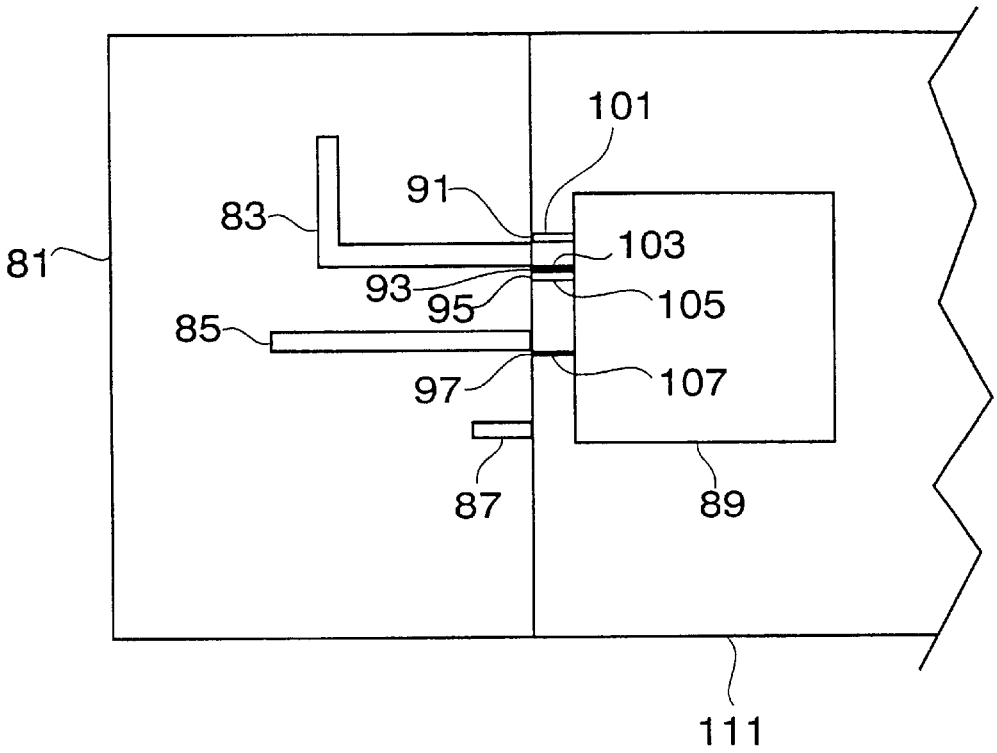
FIG. 18 is a schematic top view of an illustrative an antenna device of the present invention.
Figure 19:
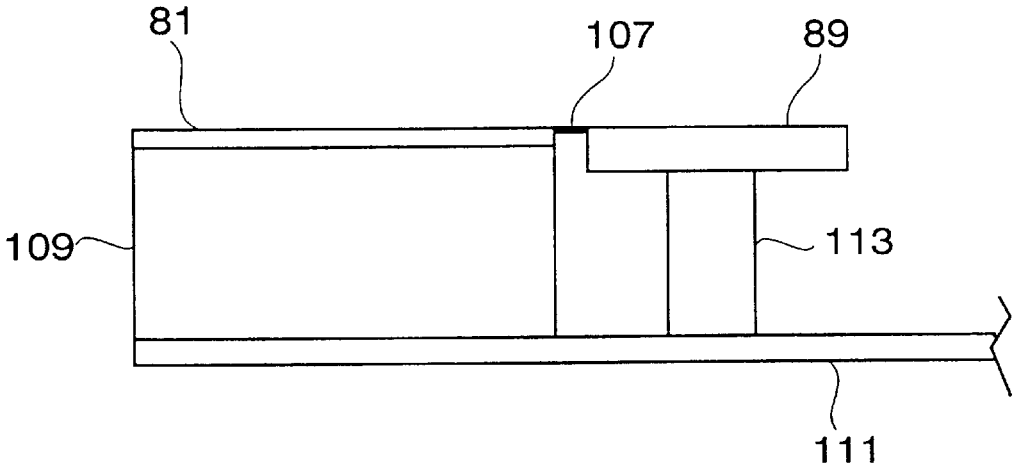
FIG. 19 is a schematic elevation view of the illustrative embodiment shown in FIG. 18.

Embodiment of FIGS. 18 and 19

Turning now to FIGS. 18 and 19, which are a schematic top view and an elevation view, respectively, of an antenna device, a further embodiment of the present invention will be depicted.

The antenna device includes a single, essentially planar patch antenna. element 81 provided with three different slots 83, 85 and 87 and adjacent thereto a switching box 89, which typically includes an array or a matrix of electrically controllable switching elements (not illustrated). Such switching elements can be PIN diode switches, or GaAs field effect transistors, FET, but are preferably microelectro-mechanical system switches (MEMS).

The patch antenna element 81 is provided with a number of RF feed and ground connection points 91, 93, 95 and 97, respectively, to each of which a respective RF feed or ground connector 101, 103, 105, and 107 is connected. Each of these connectors 101, 103, 105, and 107 is further connected to a respective switch in the switching box 89, which switch in turn is connected to an RF feed line or to ground (not illustrated).

The switching box is controlled by means of control signals supplied via one or several control lines (not illustrated) such that switching box may connect and disconnect the various RF feed and ground connectors 101, 103, 105, and 107.

The antenna element 81 is arranged on a dielectric support 109, which in turn is mounted on the main printed circuit board, PCB, 111 of a radio communication device, e.g. a mobile phone (not illustrated). The switching box 89 is arranged on a support 113, which in turn is mounted on PCB 111. Support 113 is arranged to house or carry ground connectors and RF feed and control lines interconnected between the switching box and the PCB. Preferably, the PCB is itself operating as a ground plane or similar for the antenna device.

In this particular embodiment, the antenna device is a receiver (RX) antenna device arranged for triple-band switching. Thus, the slots 83, 85 and 87, and the switchable RF feed and ground connectors 101, 103, 105, and 107 may be arranged in three different switched states optimized for receiving radio signals in three different frequency bands.

In the first of these switched states connector 101, being a ground connector, is connected to ground, connector 103, being an RF feed connector, is connected to an RF feed line, and the other connectors 105 and 107 are disconnected. Thus, opposite sides of slot 83, are connected to an RF feed line and to ground, respectively, and a slot antenna is obtained, which by way of inter alia dimensions and shape of slot 83, and positions of RF feed point 93 and ground point 91, respectively, may be optimized for receiving radio signals in e.g. the CDMA800/DAMPS800 band with a center frequency of 881.5 MHz, see Table 1. Obviously, dimensions, shapes, and locations of inter alia the patch element 81, the other slots 85 and 87 as well as of the dielectric support 109 and the PCB 111 affect the resonance frequency and the input impedance of this first switched antenna state.

ing (in which case only two slots are needed) as well as to achieve an antenna device operating in more than three frequency bands.

It shall further be appreciated that this embodiment of the invention may be modified in order to achieve an antenna device for transmitting radio frequency waves or to achieve an antenna device for both receiving and transmitting radio frequency waves.

It shall yet further be appreciated that this embodiment of the invention may encompass more RF feed and/or ground connection points, to each of which an RF feed line or a ground connector may be connected and disconnected by means of the switching box in order to alter the performance, e.g. the resonance frequency, the impedance and the radiation pattern, of the antenna device. Reference is here made to the embodiments depicted above in this description.

It shall still further be appreciated that this embodiment of the invention may encompass more than one antenna element, wherein each of these antenna elements may be selectively connected and disconnected by means of the switching box.

TABLE 1

Frequency ranges, bandwidths (BW), and center frequencies ($f_0$) of various radio communication frequency bands
All units in MHz

| Band | frequency | BW | $T_x$ | $R_x$ |
|---|---|---|---|---|
| CDMA 800/DAMPS 800 | 824–894 | 70 | 824–849 (BW = 25, $f_0$ = 836.5) | 869–894 (BW = 25, $f_0$ = 881.5) |
| GSM 900 | 890–960 | 70 | 890–915 (BW = 25, $f_0$ = 902.5) | 935–960 (BW = 25, $f_0$ = 947.5) |
| DCS 1800/PCN | 1710–1880 | 170 | 1710–1785 (BW = 75, $f_0$ = 1747.5) | 1805–1880 (BW = 75, $f_0$ = 1842.5) |
| CDMA 1900/PCS 1900 | 1850–1990 | 140 | 1850–1910 (BW = 60, $f_0$ = 1880) | 1930–1990 (BW = 60, $f_0$ = 1960) |
| CDMA 2000/UMTS | 1920–2170 | 250 | 1920–1980 (BW = 60, $f_0$ = 1950) | 2110–2170 (BW = 60, $f_0$ = 2140) |

In the second of these switched states connector 105, being a ground connector, is connected to ground, connector 107, being an RF feed connector, is connected to an RF feed line, and the other connectors 101 and 103 are disconnected. Thus, opposite sides of slot 85, are connected to an RF feed line and to ground, respectively, and a slot antenna is obtained, which by way of inter alia dimensions and shape of slot 85, and positions of RF feed point 97 and ground point 95, respectively, may be optimized for receiving radio signals in e.g. the GSM900 band with a center frequency of 947.5 MHz, see Table 1.

In the third of these switched states connector 107, being an RF feed connector, is connected to an RF feed line, and the other connectors 101, 103 and 105 are disconnected. Thus, no connected ground connector is needed. Here, slot 87 may, by way of inter alia dimensions and shape, and positions of RF feed point 97, be optimized for receiving radio signals in e.g. the CDMA2000/UMTS band with a center frequency of 2140 MHz, see Table 1.

All antenna switched states are illustratively optimized such that a relatively high input impedance of approximately 50Ω to approximately 400Ω; illustratively in the range of approximately 100Ω to approximately 300Ω; again illustratively approximately 200Ω, is obtained. By separating the RX and TX branches of the antenna function, each branch may be better and/or more easily optimized. A TX antenna device would then be optimized such that a relatively low impedance of illustratively approximately 5Ω to approximately 30Ω is obtained.

The RF feed connectors are preferably wires, cables or the like, whereas the ground connectors are preferably strips, pins, blocks or the like.

It shall be appreciated that this embodiment of the invention may be modified in order to achieve dual-band switch- It shall yet further be appreciated that this embodiment of the invention may encompass passive as well as active electrical components connectable between opposite sides of any of the slots of the antenna device.

It will be obvious that the invention may be varied in a plurality of ways. Such variations are not to be regarded as a departure from the scope of the invention. All such modifications as would be obvious to one skilled in the art are intended to be included within the scope of the appended claims.

It shall particularly be appreciated that the various embodiments as depicted in the present application may be combined in any suitable manner in order to obtain yet further embodiments of the present invention.

What is claimed is:

1. An antenna device for transmitting and/or receiving electromagnetic waves connectable to a communication device, comprising:

a radiating structure comprising at least two switchable antenna elements; and at least one switching element for selectively connecting and disconnecting said antenna elements, said at least one switching element being arranged in a central switching unit;

said at least two switchable antenna elements being connected to said switching unit, said at least two switchable antenna elements adapted to be individually switched between different coupling states; and said central switching unit having a control port for reception of control signals enabling the central switching unit to effect a centralized switching of said at least two switchable antenna elements;

the antenna device comprises a first and a second radiating structure of switchable antenna elements, and a first and a second central switching unit each assigned to a respective one of the radiating structures;

the first and the second radiating structures are separated from each other; and said at least two switchable antenna elements of the first radiating structure are connectable to transmitting circuits of the communication device, and said at least two switchable antenna elements of the second radiating structure are connectable to receiving circuits of the communication device.

2. The antenna device according to claim 1, wherein an RF feed device is connected to the central switching unit, so that said at least two switchable antenna elements can receive RF signals via said central switching unit.

3. The antenna device according to claim 1, wherein an RF ground device is connected to said central switching unit, so that at least two switchable antenna elements are RF groundable via said central switching unit.

4. The antenna device according to claim 1, wherein at least one of said at least two switchable antenna elements is provided with a plurality of spaced connection points adapted to be connectable to an RF feed or to RF ground; and said connection points are connected to said central switching unit, whereby said central switching unit switches an RF feed point and/or an RF ground point between different positions on said one of said at least two switchable antenna elements.

5. The antenna device according to claim 1, wherein said central switching unit is arranged to switch each of said at least two switchable antenna elements of said radiating structure in any of the manners of the group consisting essentially of: connecting one of said at least two switchable antenna elements to an RF feed device in series or in parallel with any other antenna element; connecting one of said at least two switchable antenna elements as a parasitic element; short-circuiting one of said at least two antenna elements; and completely disconnecting one of said at least two antenna elements.

6. The antenna device according to claim 1, wherein said radiating structure comprises at least one permanently and parasitically coupled antenna element.

7. The antenna device according to claim 1, wherein said central switching unit is arranged to be controlled in response to at least one measurable optimization parameter of antenna performance.

8. The antenna device according to claim 7, wherein said at least one optimization parameter is selected from the group consisting essentially of: measures of the transmitter reflection coefficient; measures of received signal quality; measures of received signal strength; and measures of diversity performance.

9. The antenna device according to claim 1, wherein said central switching unit is arranged to be controlled to switch the radiating structure of antenna elements between a plurality of antenna configuration states, each of said plurality of antenna configuration states being adapted for use of the antenna device in the communication device in a respective predefined operation environment.

10. The antenna device according to claim 9, wherein a first antenna configuration state of said plurality of antenna configuration states is adapted for use of the antenna device in the communication device in free space and a second antenna configuration state of said plurality of antenna configuration states is adapted for use of the antenna device in said radio communication device in a talk position.

11. The antenna device according to claim 10, wherein a third antenna configuration state of said plurality of antenna configuration states is adapted for use of the antenna device in the communication device in a waist position.

12. The antenna device according to claim 11, wherein a fourth antenna configuration state of said plurality of antenna configuration states is adapted for use of the antenna device in the communication device in a pocket position.

13. The antenna device according to claim 1, wherein said central switching unit comprises a matrix of electrically controllable a switching elements.

14. The antenna device according to claim 13, wherein said matrix includes MEMS switches.

15. The antenna device according to claim 13, wherein said matrix includes PIN diode switches.

16. The antenna device according to claim 13, wherein said matrix includes GaAs FET switches.

17. The antenna device according to claim 1, wherein at least two switchable antenna elements are selected from the group consisting essentially of loop elements, meander elements, slot elements, patch elements, whip elements, spiral elements, and helical elements.

18. The antenna device according to claim 1, wherein said at least two switchable antenna elements of said radiating structure form a symmetrical pattern around said central switching unit.

19. The antenna device according to claim 1, wherein said at least two switchable antenna elements of said radiating structure, and said central switching unit are arranged in a common plane on a carrier board.

20. The antenna device according to claim 19, wherein said at least two switchable antenna elements and said central switching unit are arranged on a printed circuit board of the communication device connected to the antenna device.

21. The antenna device according to claim 1, wherein said central switching unit is arranged in a plane spaced from the plane of said radiating structure.

22. The antenna device according to claim 1, wherein at least a portion of said radiating structure is shaped as a three-dimensional structure; and parts of said structure passes around an edge of and/or through a printed circuit board of the radio communication device connected to the antenna device, so that a portion of the radiating structure is disposed on each of two main surfaces of a printed circuit board.

23. The antenna device according to claim 1, wherein at least a portion of said radiating structure extends perpendicularly to main surfaces of a printed circuit board of the communication device.

24. The antenna device according to claim 1, wherein said at least two switchable antenna elements and said central switching unit are arranged on a first surface of a carrier board;

an RF feed device is arranged on an opposite surface of said carrier board; and an RF ground plane is laminated in said carrier board.

25. The antenna device according to claim 24, wherein said RF feed device comprises a strip line.

26. The antenna device according to claim 1, wherein said at least two switchable antenna elements or two groups of said at least two switchable antenna elements are controllable to supply receiving signals of low correlation to the radio communication device to obtain a diversity function.

27. A radio communication device comprising an antenna device according to claim 1.

28. The antenna device according to claim 1, wherein said central switching unit is arranged to be controlled depending on one or more measurable optimization parameters of the antenna performance.

29. The antenna device according to claim 28, wherein the optimization parameter or parameters are selected from the group consisting essentially of measures of the Voltage Standing Wave Ratio (VSWR), the Carrier to Noise Ratio (C/N), the Carrier to Interference Ratio (C/I), Bit Error Rate (BER), the received signal strength, and the correlation between the signals.

30. An antenna device for transmitting and/or receiving electromagnetic waves connectable to a communication device, comprising:

a radiating structure comprising at least two switchable antenna elements; and at least one switching element for selectively connecting and disconnecting said antenna elements, said at least one switching element being arranged in a central switching unit;

said at least two switchable antenna elements being connected to said switching unit, said at least two switchable antenna elements adapted to be individually switched between different coupling states; and said central switching unit having a control port for reception of control signals enabling the central switching unit to effect a centralized switching of said at least two switchable antenna elements, said at least two switchable antenna elements, jointly operate as a transmitting antenna and are connectable to transmitting circuits of the communication device; and said at least two antenna elements, jointly operating as a receiving antenna and are connectable to receiving circuits of said radio communication device.

31. An antenna device for transmitting and/or receiving RF waves connectable to a radio communication device, comprising:

a radiating structure comprising at least one antenna element; and at least one switching element connected to the at least one antenna element, wherein said at least one antenna element is provided with a plurality of spaced connection points adapted to be connectable to an RF signal feed device or to ground;

at least two of said connection points are connectable to said switching element;

said at least one switching element being arranged in a central switching unit; and said central switching unit having a control port for reception of control signals enabling said switching unit to effect a centralized switching of said connection points, wherein said at least one antenna element is a patch antenna element provided with at least a first and a second slot;

said plurality of connection points include a first and a second RF feed connection point; and said switching unit is adapted to connect said RF feed connection points to said RF signal feed device one at a time.

32. The antenna device according to claim 31, wherein said connection points are arranged at short intervals, so that there is a limited change only of the antenna performance when switching the connection point of said RF feed device or said RF ground between two adjacent connection points.

33. The antenna device according to claim 31, wherein said central switching unit is arranged to switch said RF feed device and/or said RF ground sequentially between said connection points of said at least one antenna element to optimize one or more measurable optimization parameters of antenna performance.

34. The antenna device according to claim 31, wherein said RF feed or said RF ground can be connected to more than one of said connection points at the same time.

35. The antenna device as claimed in claim 31, wherein said antenna device is optimized for receiving and/or transmitting RF waves in a first frequency band when said first RF feed connection point is connected and optimized for receiving and/or transmitting RF waves in a second frequency band when said second RF feed connection point is connected, said first and said second frequency bands being different.

36. The antenna device as claimed in claim 35, wherein said first and second frequency bands are chosen from the group consisting essentially of: CDMA800/DAMPS800, GSM900, DCS1800/PCN, CDMA1900/PCS1900, and CDMA2000/UMTS.

37. The antenna device as claimed in claim 31, wherein said plurality of said connection points further include a first ground connection point; and said central switching unit is adapted to connect said first ground connection point to ground concurrently with said first RF feed connection point being connected to said RF signal feed device.

38. The antenna device as claimed in claim 37, wherein said plurality of connection points further include a second ground connection point; and said central switching unit is adapted for connection of said second ground connection point to ground when said second RF feed connection point is connected to said RF signal feed device.

39. The antenna device as claimed in claim 38, wherein said patch antenna element is provided with a third slot; and said antenna device is optimized for receiving and/or transmitting RF waves in a third frequency band when said second RF feed connection point and said second ground connection point are connected, said third frequency band being different than said first and second frequency bands.

40. The antenna device as claimed in claim 39, wherein said first frequency band is the CDMA800/DAMPS800 band; said second frequency band is chosen from the group consisting essentially of DCS1800/PCN, CDMA1900/PCS1900 and CDMA2000/UMTS; and said third frequency band is the GSM900 band.

41. The antenna device as claimed in claim 31, wherein said antenna device is adapted to receive RF waves and wherein said antenna device has an input impedance in the range of approximately 50Ω to approximately 400Ω.

42. A method for transmitting and/or receiving electromagnetic waves using an antenna device connectable to a communication device, the method comprising:

switching of at least one of at least two switchable antenna elements centrally from a central switching unit including a switching element, and to which said at least two switchable antenna elements are individually connected;

using a first radiating structure comprising at least two of said at least two antenna elements connected to a first central switching unit as a transmitting antenna; and using a second radiating structure comprising at least two of said at least two antenna elements connected to a second central switching unit as a receiving antenna.

43. The method according to claim 42, comprising feeding selected antenna elements with RF signals via said central switching unit.

44. The method according to claim 42, comprising

RF grounding selected antenna elements via said central switching unit.

45. The method according to claim 42, comprising switching the RF feed point and/or the RF ground point between different locations on one of said at least two antenna elements, said one of said at least two switchable antenna elements provided with a plurality of spaced connection points.

46. The method according to claim 42, comprising switching each of said at least two switchable antenna elements of a radiating structure in any of the manners of the group consisting: of connecting an element to an RF feed device in series or in parallel with any other of said at least two antenna elements; connecting one of said at least two antenna elements as a parasitic elements; short-circuiting one of said at least two antenna elements; and completely disconnecting one of said at least two antenna elements.

47. The method according to claim 42, comprising controlling said central switching unit in dependence on one or more measurable optimization parameters of antenna performance.

48. The method according to claim 47, comprising controlling said central switching unit in dependence on a measurable optimization parameter selected from the group consisting essentially of: measures of the transmitter reflection coefficient, measures of received signal quality, measures of received signal strength, and measures of diversity performance.

49. The method according to claim 42, comprising controlling said central switching unit to switch said radiating structure of said at least two switchable antenna elements between a plurality of antenna configuration states;

adapting a first of said plurality of states for use of the antenna device in the communication device in free space; and adapting a second of said plurality of states for use of the antenna device in the communication device in a talk position.

50. The method according to claim 49, comprising adapting a third of said plurality of antenna configuration states for use of the antenna device in a radio communication device in waist position or in pocket position.

51. The method according to claim 42, comprising controlling said at least two switchable antenna elements or two groups of said at least two switchable antenna elements to supply receiving signals of low correlation to the communication device in order to obtain a diversity function.

52. A method for transmitting and/or receiving RF waves using an antenna device connectable to a radio communication device, the method comprising:

providing at least one antenna element with a plurality of spaced connection points adapted to be connectable to an RF signal feed device or to RF ground;

connecting at least two of said connection points to a switching element arranged in a central switching unit; and effecting a centralized switching of said connection points from said switching unit, wherein said at least one antenna element is a patch antenna element provided with at least a first and a second slot;

said at least two of said connection points that are connected to the switching element include a first and a second RF feed connection point; and said RF feed connection points are connected to said RF signal feed device, one at a time, by said switching element.

53. The method as claimed in claim 52, wherein RF waves in a first frequency band are received and/or transmitted when said first RF feed connection point is connected and RF waves in a second frequency band are received and/or transmitted when said second RF feed connection point is connected, said first and second frequency bands being different.

54. The method as claimed in claim 53, wherein said first and second frequency bands are chosen from the group of CDMA800/DAMPS800, GSM900, DCS1800/PCN, CDMA1900/PCS1900, and CDMA2000/UMTS.

55. The method as claimed in claim 52, wherein said at least two of said connection points being connected to the switching element further include a first ground connection point; and said first ground connection point is connected to ground concurrently with said first RF feed connection point being connected to said RF signal feed device.

56. The method as claimed in claim 55, wherein said at least two of said connection points further include a second ground connection point; and said second ground connection point is connected to ground provided that said second RF feed connection paint being connected to said RF signal feed device.

57. The method as claimed in claim 56, wherein said patch antenna element is provided with a third slot; and said antenna device is optimized for receiving and/or transmitting RF waves in a third frequency band when said second RF feed connection point and said second ground connection point are connected, said third frequency band being different than said first and second frequency bands.

58. An antenna device for receiving and/or transmitting RF waves and being connectable to a radio communication device provided with RF circuitry, said antenna device comprising:

a patch antenna element provided with at least two slots and at least two spaced RF feed connection points such that the antenna device is adapted to receive and/or transmit RF waves in a first frequency band when a first of said RF feed connection points is connected to said RF circuitry and adapter to receive and/or transmit RF waves in a second frequency band when the other of said RF feed connection points is connected to said RF circuitry, said first and second frequency bands being different; and a controllable switching device adapted for connection and/or disconnection of said first and said other of the at least two RF feed connection points to and/or from said RF circuitry in dependence on being supplied with control signals.

59. In an antenna device for receiving and/or transmitting RF waves and being connectable to a radio communication device provided with RF circuitry, said antenna device comprising a patch antenna element provided with at least two slots and at least two spaced RF feed connection points such that the antenna device is adapted to receive and/or transmit RF waves in a first frequency band when a first of said RF feed connection points is connected to said RF circuitry and adapted to receive and/or transmit RF waves in a second frequency band when the other of said RF feed connection points is connected to said RF circuitry, said first and second frequency bands being different, a method for switching between said at least two frequency bands comprising:

connecting said first of the at least two RF feed connection points to said RF circuitry and disconnecting said other of the at least two RF feed connection points from said RF circuitry and/or disconnecting said first of the at least two RF feed connection points from said RF circuitry and connecting said other of the at least two RF feed connection points to said RF circuitry by means of a controllable switching device.

* * * * *